US006817473B2

(12) United States Patent
Schwaikert

(10) Patent No.: US 6,817,473 B2
(45) Date of Patent: Nov. 16, 2004

(54) HOUSEHOLD PRODUCT PACKAGE WITH TAMPER EVIDENT CAP

(75) Inventor: William E. Schwaikert, Lakeville, CT (US)

(73) Assignee: WSL, LLC, Salisbury, CT (US)

( * ) Notice: Subject to any disclaimer, the term of this patent is extended or adjusted under 35 U.S.C. 154(b) by 57 days.

(21) Appl. No.: 10/138,010

(22) Filed: May 3, 2002

(65) Prior Publication Data

US 2002/0166857 A1 Nov. 14, 2002

Related U.S. Application Data

(60) Provisional application No. 60/337,675, filed on Nov. 9, 2001, and provisional application No. 60/289,925, filed on May 10, 2001.

(51) Int. Cl.[7] ..... B65D 21/036

(52) U.S. Cl. ..... 206/508; 215/373

(58) Field of Search ..... 215/371, 372, 215/373, 376, 378, 40, 43, 44, 254, 253, 251; 220/606, 605, 604, 608, 601, 562; 206/511, 509, 508

(56) References Cited

U.S. PATENT DOCUMENTS

| | | | | |
|---|---|---|---|---|
| 769,171 | A | | 9/1904 | Kray |
| 1,735,885 | A | | 11/1929 | Towle |
| 2,111,884 | A | | 3/1938 | Cahaney |
| 2,299,277 | A | | 10/1942 | Neuschaefer |
| 2,641,374 | A | | 6/1953 | Der Yuen |
| 2,661,872 | A | | 12/1953 | Trautvetter |
| D181,947 | S | | 1/1958 | Scanland |
| 3,130,056 | A | | 4/1964 | Taylor et al. |
| 3,142,404 | A | | 7/1964 | Krieps et al. |
| 3,176,879 | A | | 4/1965 | Mojonnier |
| 3,465,910 | A | | 9/1969 | Richie |
| 3,474,843 | A | | 10/1969 | Maris |
| D220,831 | S | | 6/1971 | Zimmerman et al. |
| 3,632,004 | A | | 1/1972 | Grimes et al. |
| 3,765,574 | A | | 10/1973 | Urquiza |
| 3,963,141 | A | | 6/1976 | Liu |
| 3,994,408 | A | * | 11/1976 | Belitzky ..... 215/10 |
| 4,280,653 | A | | 7/1981 | Elias |
| 4,465,205 | A | | 8/1984 | Sutch |
| 4,501,371 | A | | 2/1985 | Smalley |
| 4,632,268 | A | | 12/1986 | Melzi et al. |
| 4,656,840 | A | * | 4/1987 | Loofbourrow et al. ..... 62/530 |
| 4,664,260 | A | | 5/1987 | Stokes |
| 4,691,828 | A | | 9/1987 | Slusarczyk et al. |
| 4,708,253 | A | | 11/1987 | Mednis |
| 4,805,793 | A | | 2/1989 | Brandt et al. |
| 4,851,351 | A | | 7/1989 | Akamine |
| 4,966,292 | A | | 10/1990 | Marino |
| 5,002,199 | A | | 3/1991 | Frahm |
| 5,119,972 | A | | 6/1992 | Reed et al. |
| 5,199,570 | A | | 4/1993 | McKenzie |
| 5,224,616 | A | | 7/1993 | Crisci |

(List continued on next page.)

*Primary Examiner*—Stephen Castellano
(74) *Attorney, Agent, or Firm*—Akin Gump Strauss Haver & Feld, LLP

(57) ABSTRACT

The present invention is a generally parallelepiped shaped container including generally parallel opposite lateral side panels, generally parallel opposite longitudinal side panels and a generally flat bottom panel. A first generally flat top panel is provided near the first lateral side panel and a second generally flat top panel is provided near the second lateral side panel, the first and second top panels being interconnected to form a generally continuous top portion of the container. A dispensing neck extends upwardly from the first top panel and a cover member is removably positioned over the open end of the dispensing neck. The shape of the container and the cover member are such that the height of the cover member, when on the dispensing neck is less than the height of the second top panel so that the containers may be stacked one above the other without applying pressure to either the cover member or the dispensing neck.

9 Claims, 3 Drawing Sheets

U.S. PATENT DOCUMENTS 5,265,743 A 11/1993 Frohn
5,284,265 A 2/1994 Crisci
5,299,710 A 4/1994 Welsch et al.
5,480,028 A 1/1996 Robinson
5,573,698 A 11/1996 Mandler et al.
5,586,087 A * 12/1996 Silverson ..... 368/10
5,779,051 A 7/1998 Boutin
5,996,833 A * 12/1999 Lencioni et al. ..... 220/257.2
6,168,039 B1 1/2001 Schwaikert

* cited by examiner

HOUSEHOLD PRODUCT PACKAGE WITH TAMPER EVIDENT CAP

CROSS-REFERENCE TO RELATED APPLICATIONS

This application claims the benefit of U.S. Provisional Application No. 60/337,675, filed Nov. 9, 2001, and U.S. Provisional Application No. 60/289,925, filed May 10, 2001, the subject matter of each of which is incorporated herein by reference.

BACKGROUND OF THE INVENTION

The present invention relates generally to packaging and, more particularly, to packaging for products such as household products, particularly such packaging which is suitable for, but not restricted to, dispensing from coin operated or other automated dispensing equipment. The present invention also relates to such packaging which includes a tamper evident cover or cap.

Currently, many household products, particularly individual portions of household products such as liquid or powder laundry detergent, bleach, etc. which are dispensed from machines, such as in laundromats, are generally rectangular packages of standard dimensions to facilitate dispensing from within two primary types of coin operated dispensing equipment. The packaging of powders, liquids and sheets generally use rectangular paperboard cartons of a predetermined length, width and height to fit the specifications of the dispensing machinery. Liquids are first packaged in flexible liquid tight substrates or pouches and are then placed in paperboard cartons of a suitable size and shape so that they may also be dispensed with the same equipment. Conventional liquid packages positioned so that the opening feature is on a horizontal plane and having a size and shape to fit the specifications of existing dispensing machinery have also been used. Such extant packaging is problematic in that product leakage is a significant factor resulting in potential damage to the dispensing equipment as well as potential personal injury and property damage. In addition, the cost of providing such packaging is high.

Other packages, such as those disclosed by U.S. Pat. Nos. 2,299,277, 2,641,374, 4,708,253, 4,805,793, 5,002,199, and 5,480,028 include a variety of stackable packages which have generally parallelepiped shapes, dispensing necks, and clearance areas to permit stacking of packages. However, these patents also disclose engagement of the bottom surface of the overlying package with the top surface of the underlying package in a locking arrangement which is unsuitable for use in dispensing equipment. While still other packages, such as those disclosed by U.S. Pat. Nos. 2,111,884, 3,176,879, 3,474,843, 3,765,574, 5,265,743, 5,299,710, 5,779,051, Des. 181,947, and Des. 220,831 include stackable packages without locking engagement, none of the aforementioned patents disclose stackable packages that can be utilized in a standard dispensing machine.

The present invention comprises an improvement over the Household Product Package described in U.S. Pat. No. 6,168,039 B1, the subject matter of which is hereby incorporated herein by reference. The '039 patent discloses a container which is generally in the shape of a parallelepiped and includes a generally upwardly extending neck in one corner of the top surface of the container and a similarly sized recessed area in the same corner of the bottom surface of the container. In this manner, containers of the type disclosed can be stacked, one upon the other, as illustrated in FIGS. 2 and 3 of the '039 patent for dispensing by existing dispensing equipment. The relationship between the upwardly extending dispensing neck and the recess is such that when the containers are stacked one above the other, an underlying package may be dispensed by simply sliding the underlying package laterally from beneath the overlying package. The recessed area permits the stacking of the containers without putting undue pressure on the dispensing neck or any cap covering the dispensing neck.

The present invention is an improvement upon the container disclosed in the '039 patent. A container made in accordance with the present invention includes a dispensing neck which is recessed below the upper surface of a top panel of the container and does not include a recessed area in the bottom panel. In this manner, multiple containers made in accordance with the present invention may be stacked, within standard dispensing equipment, in the same manner as containers made in accordance with the '039 patent.

The present invention comprises a universal polymeric package which can be, but does not have to be, used for dispensing powders, liquids or virtually anything else from a standard coin operated or other standard dispensing machine. Packaging made in accordance with the present invention is structurally superior to prior art packaging due to the position and vertical location of the opening feature and the design which permits a multiplicity of such packages to be stacked one on top of the other without creating undue pressure on the opening feature or other portion of the bottom package or any intervening package which could result in breakage or leakage. Packing in accordance with the present invention includes a cap which is tamper evident for enhanced safety.

BRIEF SUMMARY OF THE INVENTION

Briefly stated, in one embodiment, the present invention comprises a container generally in the shape of a parallelepiped. The container comprises two generally parallel opposite lateral side panels and two generally parallel opposite longitudinal side panels, the lateral side panels being interconnected with the longitudinal side panels with each side panel having an upper edge and a lower edge. A first lateral side panel and first portion of each of the longitudinal side panels connected to the first lateral side panel are of a first predetermined height and a second lateral side panel and a second portion of each of the longitudinal side panels connected to the second lateral side panel are of a second predetermined height greater than the first predetermined height by at least a first predetermined distance. A generally flat bottom panel extends from and interconnects the lower edges of each of the side panels. A first generally flat top panel extends from and interconnects the upper edges of the first lateral side panel and the first portion of each of the longitudinal side panels. A second generally flat top panel extends from and interconnects the upper edges of the second lateral side panel and the second portion of each of the longitudinal side panels, the first and second top panels being interconnected to form a generally continuous top portion of the container. A dispensing neck extends upwardly from the first top panel. The dispensing neck has an open end, a predetermined length, a predetermined width and a predetermined height. A cover member is removably disposed over the open end of the dispensing neck. The cover member has an upper panel, a predetermined length, a predetermined width and a predetermined height. The height of the dispensing neck and the height of the cover member together are less than the first predetermined distance so that the upper panel of the cover member does not extend beyond the second top panel.

In a second embodiment, the present invention comprises a container generally in the shape of a parallelepiped. The container comprises two generally parallel opposite lateral side panels and two generally parallel opposite longitudinal side panels, the lateral side panels being interconnected with the longitudinal side panels and with each side panel having an upper edge and a lower edge. A generally flat bottom panel extends from and interconnects the lower edges of each of the side panels. First and second top panels are provided, the second top panel including two generally flat spaced apart sections, a first section being connected to the upper edge of a first lateral side panel and to the upper edges of a first portion of each of the longitudinal side panels proximate to the first lateral side panel and a second section being connected to the upper edge of the second lateral side panel and to the upper edges of a second portion of each of the longitudinal side panels proximate to the second lateral side panel. The first top panel extends from and interconnects the first and second sections of the second top panel and the upper edge of a third portion of a first longitudinal side panel, the third portion being located between the first and second portions of the first longitudinal side panel. The second top panel is at a height which is greater than the height of the first top panel by a predetermined distance. A dispensing neck extends upwardly from the first top panel. The dispensing neck has an open end, a predetermined length, a predetermined width and a predetermined height. A cover member is removably disposed over the open end of the dispensing neck. The cover member has an upper panel, a predetermined length, a predetermined width and a predetermined height. The height of the dispensing neck and the height of the cover member together are less than the predetermined distance so that the upper panel of the cover member does not extend beyond the second top panel.

The present invention, in a third embodiment comprises a cover member for a container including a generally circular upper panel, a generally cylindrical skirt extending downwardly form the periphery of the upper panel and a liftable tab member. The liftable tab member is formed by creating a pair of weakened areas in a portion of the upper panel and a portion of the skirt such that lifting the tab member separates the tab member from the upper panel and the skirt along the weakened areas so that the tab member may be lifted to remove the cover member from the container.

BRIEF DESCRIPTION OF THE SEVERAL VIEWS OF THE DRAWINGS

The forgoing summary as well as the following detailed description of presently preferred embodiments of the invention will be better understood when read in conjunction with the appended drawings. For the purpose of illustrating the invention, there are shown in the drawings embodiments which are presently preferred. It should be understood, however, that the present invention is not limited to the particular arrangements and instrumentalities shown. In the drawings.

DETAILED DESCRIPTION OF THE INVENTION

The present invention comprises a package for containing a product such as household goods or other products of the type which can be, but does not have to be, dispensed from a standard coin operated or other dispensing machine. In particular, the presently described embodiment of the present invention comprises a standard sized package which is sized to be usable within standard dispensing machines and which has substantial structural integrity such that a large number of such packages, with the product therein, can be stacked one upon another without resulting in damage, leakage or the like to the bottom package or any of the intervening packages. Packages made in accordance with the present invention may be stacked in a standard dispensing machine in virtually any orientation permissible by the machine. In addition, because of the unique structure of the package, the orientation of all of the packages in a dispensing machine need not be the same. That is, a first package could be oriented with the dispensing neck toward the front of the machine with the dispensing neck extending upwardly, an overlying package could be oriented with the dispensing neck facing downwardly and a further overlying package could be oriented with the dispensing neck facing upwardly but at the rear portion of the machine. Thus, a package in accordance with the present invention provides great flexibility of orientation when used with such standard dispensing equipment.

Figure 1:
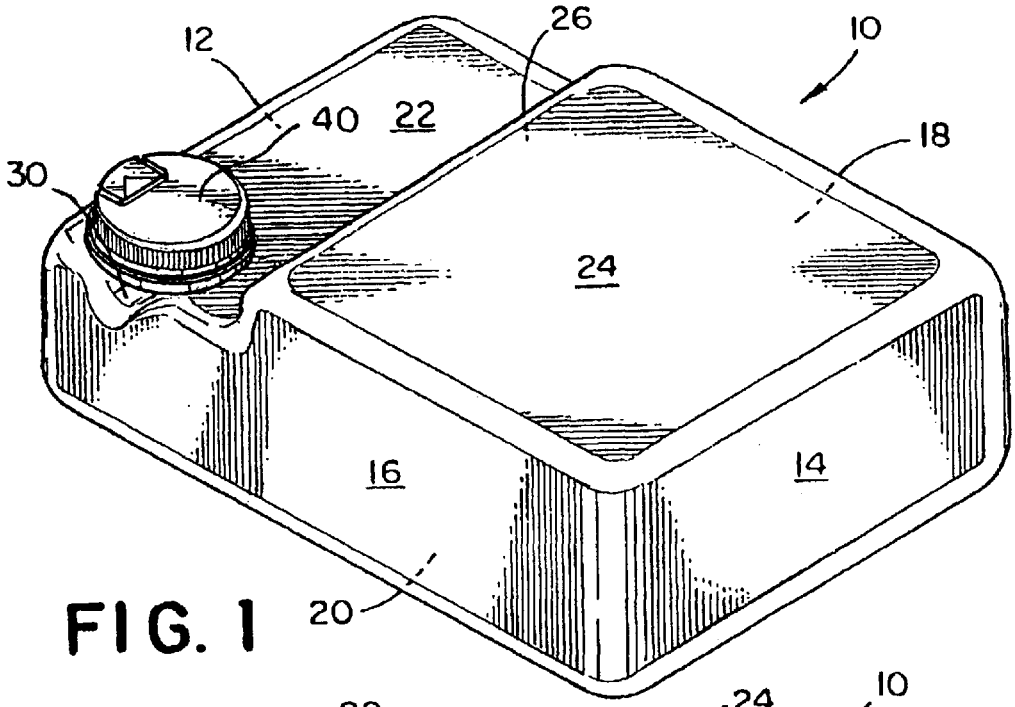
FIG. 1 is a perspective view of a container in accordance with a first preferred embodiment of the present invention.
Figure 2:
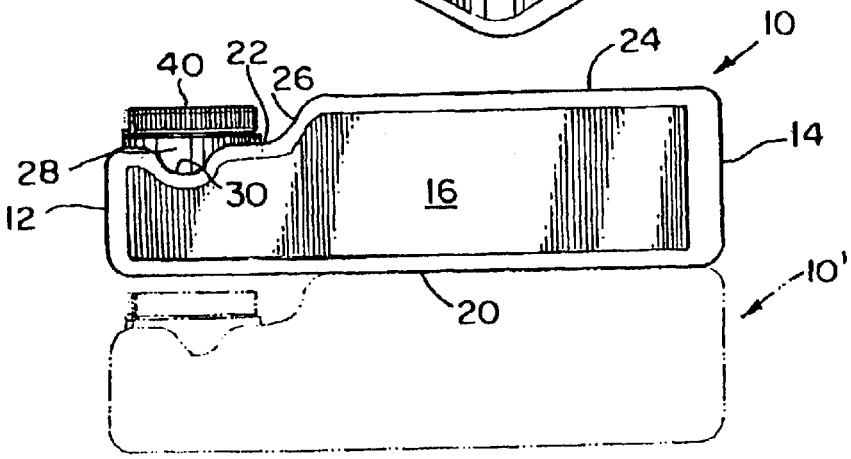
FIG. 2 is a front elevational view of the container of FIG. 1.
Figure 3:
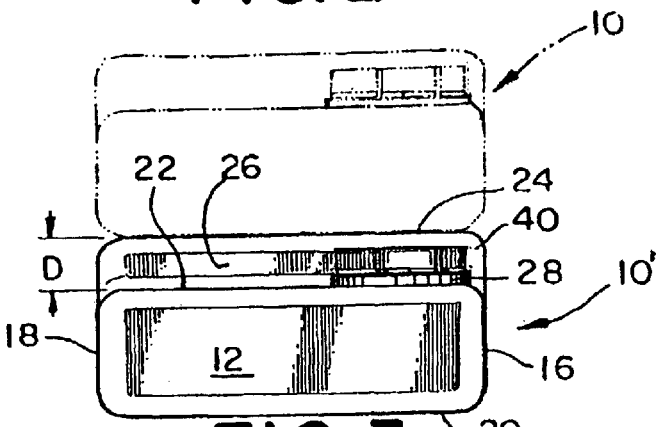
FIG. 3 is a left side elevational view of the container of FIG. 1.

FIGS. 1–3 illustrate a package or container 10 in accordance with a first preferred embodiment of the present invention. The container 10 is generally in the shape of a parallelepiped with generally parallel opposite lateral side panels 12 and 14 and generally parallel opposite longitudinal side panels 16 and 18. As shown in FIGS. 1–3, in the present embodiment, the lateral side panels 12 and 14 are both generally rectangularly shaped and are of the same length which is established by the distance between the two generally parallel longitudinal side panels 16 and 18. However, the lateral side panels 12 and 14 are of different heights with the first lateral side panel 12 being of a first predetermined height and the second lateral side panel 14 being of a second predetermined height which is greater than the first predetermined height. In the present embodiment, the difference in height between the first lateral side panel 12 and the second lateral side panel 14 establishes a first predetermined distance D, the significance of which will here and after become apparent. Preferably, both of the lateral side panels 12 and 14 are generally flat and each lateral side panel 12 and 14 includes an upper edge, a lower edge, and opposite side edges.

The longitudinal side panels 16 and 18 are also generally flat and are of substantially the same length, which is established by the distance between the lateral side panels 12 and 14. However, the longitudinal side panels 16 and 18 are generally step-like in that they each include two portions having different heights. The first portions of the longitudinal side panels 16 and 18, which are interconnected with the first lateral side panel 12 are of a predetermined height which corresponds to the first predetermined height of the first lateral side panel 12. Similarly, the second portion of each of the longitudinal side panels 16 and 18 which are interconnected with the second lateral side panel 14 are of a predetermined height which corresponds to the second predetermined height of the second lateral side panel 14. Each of the longitudinal side panels 16, 18 includes a lower edge and side edges. The longitudinal side panels 16 and 18 also each include upper edges, which are formed of three interconnected portions, two straight portions at either lateral end and an angled intermediate portion. As illustrated, the lateral side panels 12 and 14 are interconnected with the longitudinal side panels 16 and 18 along their respective side edges. In this manner, the two generally parallel lateral side panels 12 and 14 and the two generally parallel longitudinal side panels 16 and 18 form the generally parallelepiped-shaped container 10. Preferably, the edges where the lateral side panels 12 and 14 are interconnected with the longitudinal side panels 16 and 18 are all rounded as shown to provide a more pleasing appearance and to relieve stress concentrations at the edges.

The container 10 further includes a generally flat bottom panel 20, which is generally rectangularly shaped and includes four edges. The edges of the bottom panel 20 are interconnected with the lower edges of the lateral and longitudinal side panels 12, 14, 16 and 18. Preferably, the intersections of the edges of the lateral and longitudinal side panels 12, 14, 16 and 18 and the bottom panel 20 are all rounded as shown to provide for a more pleasing appearance and to relieve stress concentrations.

As best shown in FIG. 1, the container 10 further includes a first generally flat top panel 22, a second generally flat top panel 24 and a third or transition top panel 26 extending between and interconnecting the first and second top panels 22 and 24 to form a generally continuous top portion of the container 10. As shown, the width of each of the top panels 22, 24 and 26 is generally the same and generally corresponds to the length of the lateral side panels 12 and 14 (the distance between the longitudinal side panels 16 and 18). The first top panel 22 extends from and is interconnected with the upper edge of the first lateral side panel 12 and the upper edges of the first portion of each of the longitudinal side panels 16 and 18. Similarly, the second top panel 24 extends from and is interconnected with the upper edge of the second lateral side panel 14 and the upper edges of the second portion of each of the longitudinal side panels 16 and 18. In this manner, the combination of the first, second and third top panels 22, 24 and 26 effectively forms a generally continuous top portion for generally enclosing the container 10. Preferably, the interconnections of the upper edges of the lateral and longitudinal side panels 12, 14, 16 and 18 with the top panels 22, 24 and 26 are all rounded as shown in order to provide a more pleasing appearance and to relieve stress concentrations. Preferably, the width of the second top panel 24 is greater than the width of the first top panel 22 and more preferably is more than twice the width of the first top panel 22 for purposes which will hereinafter become apparent.

Figure 10:
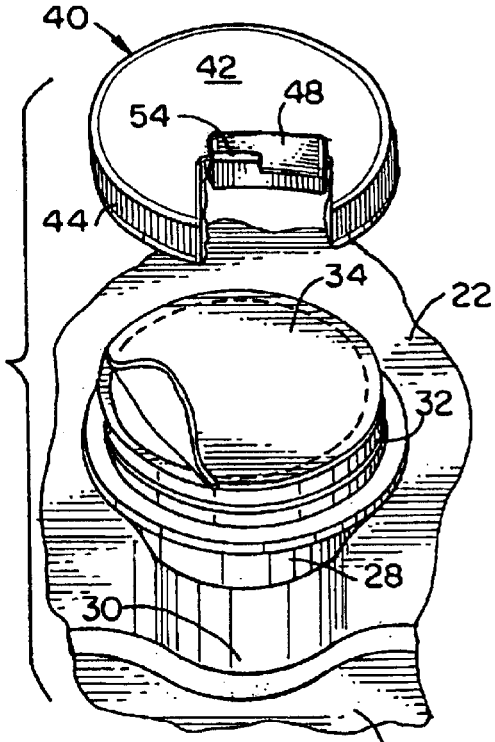
FIG. 10 is an exploded perspective view showing the cap removed from the remainder of the container.

The container 10 further includes a dispensing neck 28 which, in the present embodiment, extends upwardly from the first top panel 22. Preferably, the dispensing neck 28 is located proximate to a corner formed by the first top panel 22 and the interconnection of the first lateral side panel 12 and longitudinal side panel 16 but it could be at some other location on the first top panel 22, if desired. Preferably, the dispensing neck 28 is generally cylindrically shaped, although those skilled in the art will realize that the dispensing neck 28 could be of some other shape, if desired. The upper or distal end of the dispensing neck 28 is open (See FIG. 10) to provide access to the interior of the container 10 to permit the insertion or removal of product from within the interior of the container 10. The dispensing neck 28 has predetermined dimensions including a predetermined length, a predetermined width (in the present embodiment since the dispensing neck 28 is circular the length and width are the same) and a predetermined height by which the distal end of the dispensing neck 28 extends above the surface of the first top panel 22. Preferably, the width of the first top panel 22 is greater than the width or diameter of the dispensing neck 28. Preferably the first top panel 22 includes a small lip or recessed area 30 spaced a short distance from the corner in which the dispensing neck 28 is located. As best shown in FIG. 10, the dispensing neck 28 includes a generally circular flange member 32 extending radially outwardly from the outer surface of the dispensing neck 28 at a location which is at least slightly spaced apart from the upper or distal end of the dispensing neck 28. The purpose of the recessed area 30 and the flange member 32 will hereinafter become apparent.

Described above is the basic structure of a container 10 in accordance with a first preferred embodiment of the present invention. Preferably, the container 10 is made of a strong polymeric material, such as polypropylene, polyvinylchloride, polyethylene, polystyrene or the like in mono layers or multi layers in order to provide a strong, lightweight, inexpensive package which guards against leakage of any product contained therein. Other materials such as paperboard or coated paperboard could be used. Preferably, the container 10 is made utilizing a molding or blow molding process in a manner well known to those of ordinary skill in the art. It will be appreciated that the container 10 could be made of other materials or could be produced in some other manner.

In the present embodiment, as shown in FIG. 10, once product has been inserted into the container 10, the opening of the dispensing neck 28 is covered by a seal 34. Preferably the seal 34 includes a tab (not shown) which a user may grasp to facilitate removal of the seal 34 from the dispensing neck 28. Preferably the seal 34 is made of a breathable material to allow gases which may build up in the container 10 to be released without leaking any product held within the container 10. Alternatively, the seal 34 can be made of a non-breathable material. Materials for the seal could be selected from the group consisting of Tyvek ®, polymeric films, metallic foils including aluminum foils, paper foils, leak-proof films, leak-proof foils, polypropylene, polyvinylchloride, polyethylene and polystyrene. The seal 34 can be secured over the open end of the dispensing neck 28 by one of an adhesive, induction sealing, sonic welding, conductive sealing or other comparable methods known to those skilled in the art.

Figure 11:
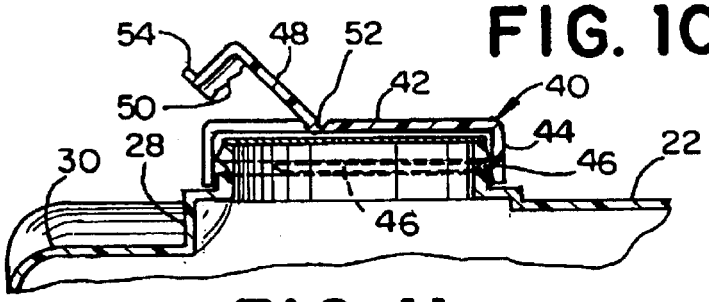
FIG. 11 is a sectional view of a portion of the container and the cap taken along line 11—11 of FIG. 9.

As best shown in FIGS. 7–11, the seal 34, in turn, is covered by a single use cover member or cap 40. The cap 40, in the present embodiment, includes a generally flat, generally circular upper panel 42 and a generally cylindrical skirt 44 extending downwardly from the periphery of the upper panel 42. The interior surface of the skirt 44 includes a generally inwardly extending flange 46 proximate the downward or lower end thereof. As best shown in FIG. 11, when the cap 40 is installed on the dispensing neck 28 the flange 46 on the interior surface of the skirt 44 snaps over the flange 32 on the radial outer surface of the dispensing neck 28 to effectively lock the cap 40 in place on the dispensing neck 28. The inner dimension of the skirt 44 is slightly greater than the outer dimension of the dispensing neck 28 so the cap 40 may be rotated as shown by the arrows in FIG. 7.

Figure 7:
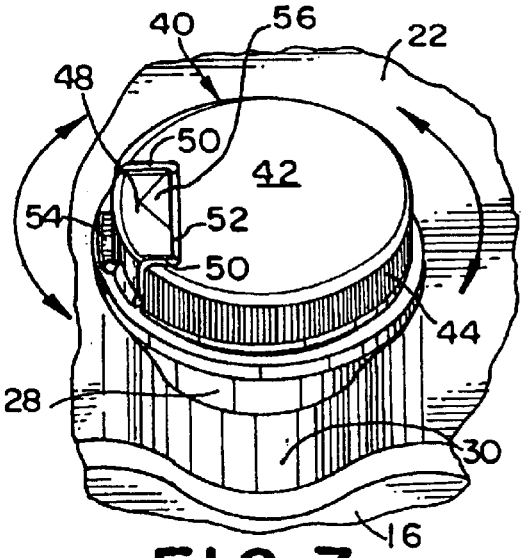
FIG. 7 is an enlarged perspective view of the cap portion of the containers of FIGS. 1 and 4.
Figure 8:
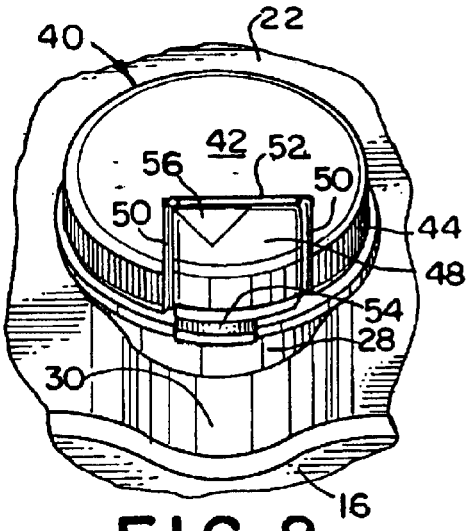
FIG. 8 is a perspective view similar to FIG. 7 but with the cap rotated approximately 90 degrees.

As best shown in FIGS. 7–11, the cap 40 further includes a liftable tab member 48 which is created within portions of the upper panel 42 and the skirt 44 to facilitate removal of the cap 40. Preferably the tab member 48 is generally irregularly shaped and is formed by creating a pair of generally parallel weakened areas 50, which extend along the upper panel 42 and the skirt 44 of the cap 40. As best shown in FIG. 8, the weakened areas 50 are generally parallel to each other but do not extend radially through the center of the cap 40. In this manner, the tab member 48 is off center with respect to the cap 40 to provide additional leverage for removal of the cap 40 in a manner which will hereinafter be described. A hinge line 52 extends along the upper panel 42 between the distal ends of the weakened areas 50.

Figure 9:
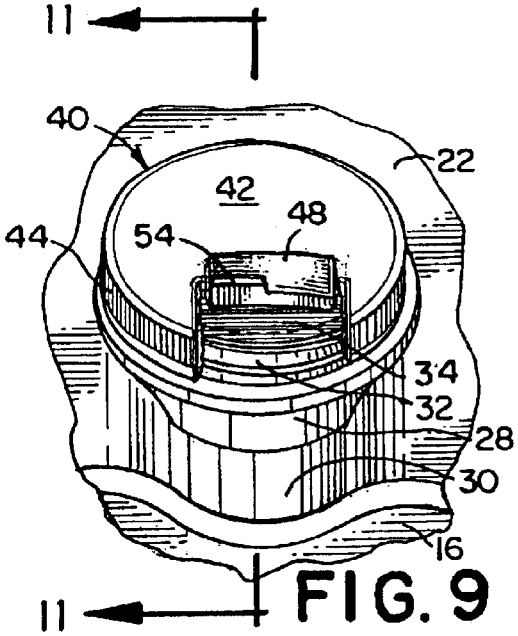
FIG. 9 is a perspective view similar to that of FIG. 8 but showing the tab member of the cap in a raised position.

The lower portion of the tab member 48 also includes a gripping lug 54 extending slightly outwardly beyond the radial periphery of the skirt 44. The gripping lug 54 permits a user to pull upwardly on the tab member 48 thereby breaking the tab member 48 away from the remainder of the cap 40 along the weakened areas 50 and permitting the tab member 48 to bend upwardly along the hinge line 52 as shown in FIGS. 9–11. Further upward pulling on the gripping lug 54 and/or the tab member 48 permits the cap 40 to be pulled or peeled away from the dispensing neck 28 as shown in FIG. 10 to provide access to the seal 34 for dispensing product form the container 10. Once the cap 40 and the seal 34 have been removed product within the container 10 may be dispensed by pouring the product out of the open end of the dispensing neck 28 and thereafter using the recessed area 30 to serve as a pouring lip. Locating the dispensing neck 28 proximate to the corner of the container and including the recessed area 30 facilitates pouring of either a powder, liquid or the like from the container 10. It will be appreciated by those skilled in the art that while it is presently preferred that the dispensing neck 28 be located proximate to a corner of the container 10, the dispensing neck 28 may be located in any other suitable position, preferably along one of the edges of the first top panel 22, as long as the recessed area 30 is suitably sized and positioned beneath or near the dispensing neck 28. Preferably the cap 40 is made of a polymeric material such as polypropylene, polyvinylchloride or the like. Preferably the cap 40 is of a color which is different from the color of the container 10 in order to make the cap 40 more visible.

As shown in FIG. 7, the upper surface of the tab member 48 includes an arrow 56 which helps to focus the attention of a user on the location of the gripping lug 54. In order to permit a user to engage the gripping lug 54, it is necessary to rotate the cap 40 so that the arrow 56 and the gripping lug 54 are aligned with the recessed area 30 (see FIG. 8) in the container 10 proximate to the dispensing neck 28 to permit the user to get a thumb or finger under the gripping lug 54 to aid in lifting the tab member 48. Orienting the cap 40 in any other manner (i.e. so that the arrow 56 and the gripping lug 54 are not aligned with the recess 30, as in FIG. 7) makes it difficult for a user to effectively grasp the gripping lug 54 to lift the tab member 48 for removal of the cap 40. By requiring such precise alignment for removal of the cap 40, the container 10 includes a child resistant feature. In addition, as will be apparent to those of ordinary skill in the art, once the tab member 48 has been lifted as shown in FIG. 10 such that the weakened areas 50 are broken, the cap 40 cannot be successfully returned to its original position as shown in FIG. 7 thereby providing a tamper-evident feature to the container 10.

FIGS. 2 and 3 illustrate the stackability of the container 10 made in accordance with the present invention. As best shown in FIG. 2, when two containers 10, 10' are stacked one above the other, all of the weight of the overlying container 10 is effectively borne by the second top panel 24 of the underlying container 10'. More particularly, and as clearly illustrated by FIG. 2, the distance by which the combination of the dispensing neck 28 and the cap 40 extend above the surface of the first top panel 22 is at least slightly less than the distance D that the second top panel 24 extends above the first top panel 22. Thus, as is clearly shown in FIGS. 2 and 3, there is at least a slight clearance between the upper panel 42 of the cap 40 of an underlying container 10' and the bottom panel 20 of an overlying container 10, when the containers are stacked as shown. In this manner, the bottom container 10' may be slid outwardly for dispensing from a stack of containers within a dispensing machine without affecting, in any manner, the position of any overlying container 10. In addition, although containers 10 made in accordance with the present invention are preferably for use with a standard vending machine, a large number of such containers 10 can be stacked one on top of the other, outside of a vending machine, for example, on a store shelf, without resulting in damage, leakage or the like to the bottom container or any of the intervening containers. The ability of the containers 10 to stack in this manner without any undue pressure being provided on the cap 40 or dispensing neck 28 of any underlying container also provides a significant advantage when packaging a large number of containers 10 in bulk for shipping and/or sampling outside of vending machines.

Figure 4:
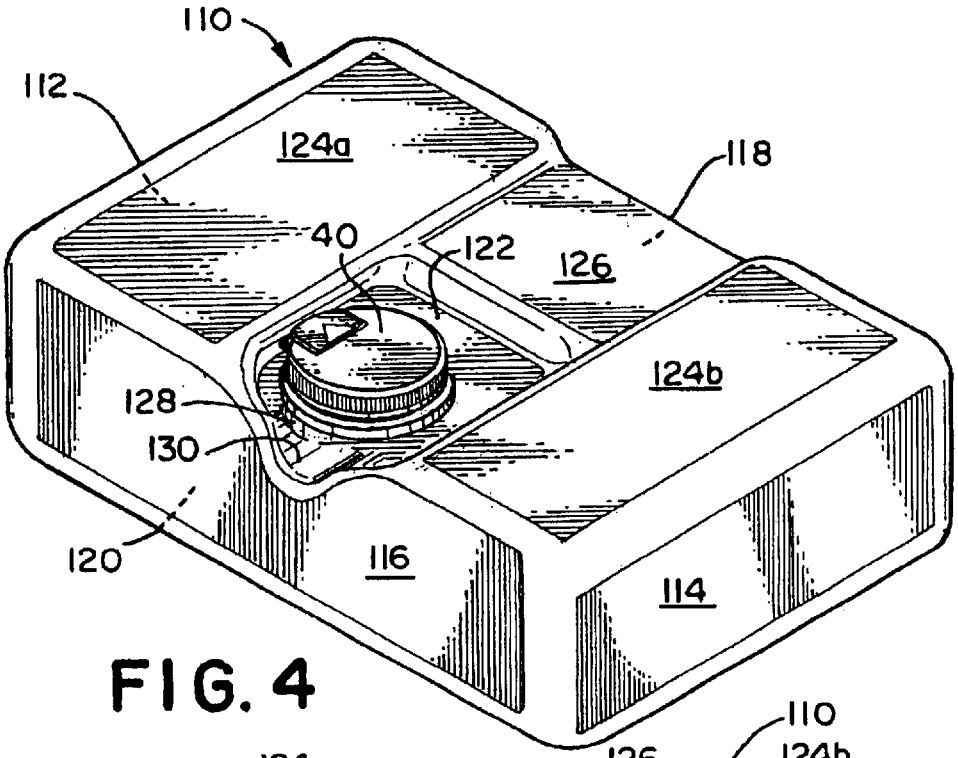
FIG. 4 is a perspective view of a container in accordance with a second preferred embodiment of the present invention.
Figure 5:
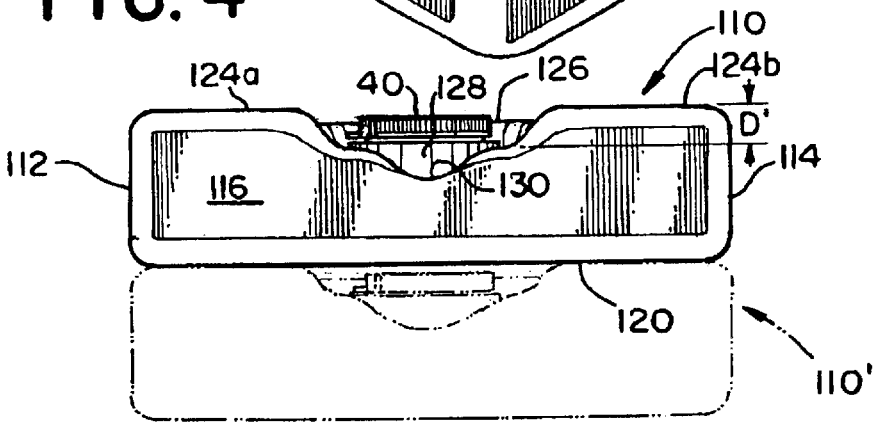
FIG. 5 is a front elevational view of the container of FIG. 4.
Figure 6:
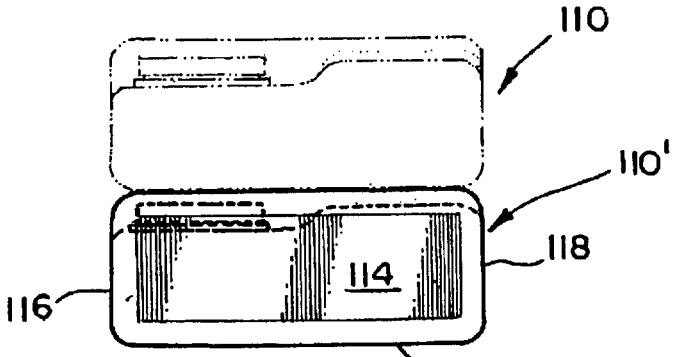
FIG. 6 is a left side elevational view of the container of FIG. 4.

FIGS. 4–6 illustrate a package or container 110 in accordance with a second preferred embodiment of the present invention. As with the above-described embodiment, the container 110 is generally in the shape of a parallelepiped with generally parallel opposite lateral side panels 112 and 114 and generally parallel opposite longitudinal side panels 116 and 118. As shown, in the present embodiment, the lateral side panels 112 and 114 are both generally rectangularly shaped and are of the same length established by the distance between the two generally parallel longitudinal side panels 116 and 118. However, unlike the above-described embodiment, in the present embodiment, the lateral side panels 112 and 114 are of the same height.

The longitudinal side panels 116 and 118 are also generally flat and are of substantially the same length, which is established by the distance between the lateral side panels 112 and 114. However, unlike the longitudinal side panels 16 and 18 of the above-described embodiment, the longitudinal side panels 116 and 118 of the present embodiment include first and second portions proximate to the respective lateral side panels 112 and 114, which are of the same height as the lateral side panels 112 and 114 and a third portion located between the first and second portions which are each of a height which is less than the height of the first and second portions.

As with the above-described embodiment, both the lateral side panels 112 and 114 and the longitudinal side panels 116 and 118 include a lower edge, side edges and an upper edge, the upper edges of the longitudinal side panels 116 and 118 being formed of three interconnected portions. As with the above-described embodiment, the lateral side panels 112 and 114 are interconnected with the longitudinal side panels 116 and 118 along their respective side edges. In addition, the container 110 includes a generally flat bottom panel 120 which is generally rectangularly shaped and includes four edges. The edges of the bottom panel 120 are interconnected with the lower edges of the lateral and longitudinal side panels 112, 114, 116 and 118. As with the above-described embodiment, all of the interconnections of the panels are rounded to provide for a more pleasing appearance and to relieve stress concentrations.

As best shown in FIG. 4, the container 110 includes an upper or top surface, which is formed of first, second and third top panels. The second top panel includes two generally flat spaced apart sections 124*a* and 124*b*. The first section 124*a* is connected to the upper edge of the first lateral side panel 112 and to the upper edges of the first portion of each of the longitudinal side panels 116 and 118 proximate to the first lateral side panel 112. The second section of the second top panel 124*b* is connected to the upper edge of the second lateral side panel 114 and to the upper edges of the second portion of each of the longitudinal side panels 116 and 118 proximate to the second lateral side panel 114. Since, as described above, both the first and second portions of each of the longitudinal side panels 116 and 118 are of the same height, both sections of the second top panel 124*a* and 124*b* are at substantially the same height with respect to the bottom panel 120.

The first top panel 122 extends from and interconnects portions of the first and second sections of the second top panel 124*a* and 124*b* and the upper edge of the third portion of the first longitudinal side panel 116, the third portion being located between the first and second portions. As can best be seen in FIG. 5, the height of the third portion of the first longitudinal side panel 116 and thus the height of the first top panel 122 is less than the height of the two sections of the second top panel 124*a* and 124*b* by at least a predetermined distance D'.

A third or transition top panel 126 extends between and interconnects portions of the first and second sections of the second top panel 124*a* and 124*b*, the first top panel 122 and the third portion of the second longitudinal side panel 118, the third portion being located between the first and second portions. As best seen in FIGS. 5 and 6, the third top panel 126 is at a height which is between the height of the first top panel 122 and the height of the first and second sections of the second top panel 124*a* and 124*b*. In this manner, the combination of the first top panel 122, the first and second sections of the second top panel 124*a* and 124*b* and third top panel 126 effectively form a generally continuous (but irregular) top surface for generally enclosing the top of the container 110.

The container 110 of the second preferred embodiment includes a dispensing neck 128 which extends upwardly form the first top panel 122 in substantially the same manner as the dispensing neck 28 as described above in connection with the first preferred embodiment. In fact, the dispensing neck 128 includes all of the same characteristics as the dispensing neck 28 described above. The first top panel 122 also includes a small lip or recessed area 130 substantially as described above in connection with the first preferred embodiment. The structure of the container 110 in accordance with the second preferred embodiment of the present invention is substantially as described above in connection with the first preferred embodiment but with the above-noted structural changes. Accordingly, the container 110 may be made of the same materials as described above utilizing the same techniques as described above. The container 110 also includes a seal 34, which is the same as described above and a cover member or cap 40, which also is the same as described above. A container 110 in accordance with the second preferred embodiment functions in the same manner as described above in connection with the first preferred embodiment. Accordingly, further details of the structure, operation and use of the second preferred embodiment are not believed to be necessary for a complete understanding of the container 110. Like the first preferred embodiment, the second preferred embodiment 110 may be dispensed from a dispensing machine or may be stacked as illustrated by FIGS. 5 and 6 for a storage, shipping or other environment. As shown in FIGS. 5 and 6, when two containers in accordance with the second preferred embodiment are stacked one above the other, sufficient clearance exists between the top of the cap 40 of the underlying container 110' and the bottom panel 120 of the overlying container 110 to allow for convenient dispensing of the underlying container and so that no weight or pressure is placed on the cap 40.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. A stackable container assembly comprising:

a one-piece, molded, unitary container generally in the shape of a parallelepiped including:

two generally parallel opposite lateral side panels, each lateral side panel defining one, and only one, lateral side plane, and two generally parallel opposite longitudinal side panels, each longitudinal side panel defining one, and only one, longitudinal side plane, the lateral side panels being directly connected with the longitudinal side panels, each side panel having an upper edge and a lower edge;

a generally flat bottom panel extending from and interconnecting the lower edges of each of the side panels and defining a bottom plane;

first and second top panels, the first top panel defining a first plane and the second top panel including two generally flat spaced apart coplanar sections defining a second plane, a first section being directly connected to the upper edge of a first lateral side panel and to the upper edges of a first portion of each of the longitudinal side panels proximate to the first lateral side panel and a second section being directly connected to the upper edge of the second lateral side panel and to the upper edges of a second portion of each of the longitudinal side panels proximate to the second lateral side panel;

the first top panel extending from and being directly connected to the first and second sections of the second top panel and the upper edge of a third portion of a first longitudinal side panel, the third portion being located between the first and second portions of the first longitudinal side panel, the second top panel being at a height which is greater than the height of the first top panel by a predetermined distance;

a transition top panel defining a single, horizontal planar surface extending above the first top panel and extending below the second top panel, said single, horizontal planar surface directly interconnecting and sharing common edges with each of the first top panel, the first and second sections of the second top panel and a third portion of the second longitudinal side panel; and a dispensing neck extending upwardly from the first top panel, the dispensing neck having an open end, a predetermined length, a predetermined width and a predetermined height; and a cover member removably disposed over the open end of the dispensing neck, the cover member having an upper panel, a predetermined length, a predetermined width and a predetermined height, a combination of the dispensing neck and the cover member secured to the dispensing neck having a predetermined height equal to a vertical distance from the top of the upper panel of the cover member to a lowermost edge of the dispensing neck, the lowermost edge being at a height generally equal to the height of the first top panel, such that the predetermined height of the combination is less than the predetermined distance and the upper panel of the cover member when secured to the dispensing neck does not extend beyond the second plane, whereby the container is fully enclosed by a volume defined by the lateral side planes, the longitudinal side planes, the bottom plane and the second plane and, whereby when container assemblies are stacked one on top of another, the weight of each overlying container is substantially borne by the second top panel of each underlying container with none or at most an insubstantial portion of the weight of any overlying container being borne by the cover member or dispensing neck of any underlying container.

2. The container as recited in claim 1 further including a recessed area in the first top panel located below the first plane and proximate to the dispensing neck to facilitate removal of the cover member.

3. The container as recited in claim 1, wherein the interconnections of the lateral side panels to the longitudinal side panels, the bottom panel to the side panels and the first and second top panels to the side panels and to each other are all rounded.

4. The container as recited in claim 1, wherein the cover member is tamper evident.

5. The container as recited in claim 1, wherein the cover member comprises:

a generally circular upper panel;

a generally cylindrical skirt extending downwardly from the periphery of the upper panel; and a liftable tab member formed by creating a pair of weakened areas in a portion of the upper panel and a portion of the skirt such that lifting the tab member separates the tab member from the upper panel and the skirt along the weakened areas so that the tab member may be used to lift the cover member off of the dispensing neck.

6. The container as recited in claim 5, wherein the weakened areas are generally parallel to each other.

7. The container as recited in claim 6, wherein a hinge line extends between the distal ends of the weakened areas.

8. The container as recited in claim 5, wherein the cover member further includes a gripping lug extending outwardly form the skirt portion of the tab member to facilitate lifting the tab member.

9. The container as recited in claim 5 further comprising a recessed area located below the first plane and proximate to the dispensing neck, wherein the cover member further includes an arrow for alignment of the tab member with the recessed area to facilitate lifting of the tab member for removal of the cover member.

* * * * *